US005474110A

United States Patent [19]

Mettler

[11] Patent Number: 5,474,110

[45] Date of Patent: Dec. 12, 1995

[54] HEDDLE THREAD EYE

[75] Inventor: Franz Mettler, Wollerau, Switzerland

[73] Assignee: Grob & Co. Aktiengesellschaft, Horgen, Switzerland

[21] Appl. No.: 271,975

[22] Filed: Jul. 8, 1994

[30] Foreign Application Priority Data

Oct. 25, 1993 [DE] Germany ..... 43 36 362.8

[51] Int. Cl.[6] ..... D03C 9/02

[52] U.S. Cl. ..... 139/93

[58] Field of Search ..... 139/93

[56] References Cited

U.S. PATENT DOCUMENTS 997,283 11/1911 Feher et al. .
2,249,390 7/1941 Mahler ..... 139/93
3,049,151 8/1962 McFetter ..... 139/93 X
5,052,446 10/1991 Gysin ..... 139/93
5,092,370 3/1992 Anderson ..... 139/93
5,348,055 9/1994 Kramer ..... 139/93

FOREIGN PATENT DOCUMENTS 59-199283 11/1984 Japan .

*Primary Examiner*—Andy Falik
*Attorney, Agent, or Firm*—Watson, Cole, Grindle & Watson

[57] ABSTRACT

A heddle for a weaving machine is in the form of an elongated strip having opposed end portions lying in a common flat plane, the strip having a thread eye portion intermediate such end portions. The thread eye portion lies in a plane rotated in the range of 10° to 20° about the central axis of the heddle, the eye portion comprising a pair of spaced legs defining a thread eye. The legs lie in respective planes parallel to and spaced from opposite sides of the common flat plane of the heddle.

4 Claims, 3 Drawing Sheets

HEDDLE THREAD EYE

BACKGROUND OF THE INVENTION

This invention relates to a heddle for a weaving machine, and more particularly to such a heddle having a thread eye portion which provides for easier passing of the warped threads therethrough while at the same time permitting easier and smoother passage of the adjacent warp threads past the adjoining heddles.

Known heddles are typically made of strip steel supported at opposite ends on heddle frames of a weaving machine. The heddles are supported in such manner that the major plane of the heddle is parallel to the course of the warp thread. Since the warp thread must be guided by the heddle, it is provided with a thread eye which, however, oftentimes presents a problem since the heddle is disposed incorrectly as soon as it is strung on the heddle frame. The correct relationship of the heddle to the warp thread would be perpendicular.

Since it is not possible to guide the warp threads through the plane of the strip steel of the heddle, the heddle must be deformed in the region of the thread eye to enable the passage of the warp thread therethrough.

There are two types of such deformation; twisting or rotation, and crossed or corrugated. The rotation of the thread eye portion relative to the plane of the strip typically lies in a plane rotated 25° to 30° about the central axis of the heddle. In the so-called crossed mode of deformation, the opposed legs comprising the thread eye are pulled apart to enable the passage of the warped thread.

Both deformation modes have their advantages and drawbacks. The rotated style offers the warped thread a relatively good thread support in the thread eye, a feature that has the effect of preserving the thread. However, the adjacent warp threads must slide over a wider area over the protruding edges of the rotated portion. Thus, as the rate of weaving increases, this creates a problem.

The warp threads of the crossed mode must also slide over the edges, but the region is significantly shorter than compared to that of the rotated mode. However, the height of the detoured path of the warp thread is somewhat greater such that thread deflection occurs suddenly. Moreover, with such crossing of the thread eye no real support is offered to the thread but rather there is a tendency to pinch the thread.

With both types of thread eye construction the adjacent warp threads must rotate the heddle by a certain amount out of its original plane, in order to create a sufficiently unobstructed passage both for the warp thread in the thread eye and the adjacent threads.

Japanese Patent No. 59-199834 discloses a heddle which is formed by first rotating the region of the thread eye with the opposed legs forming the eye being deformed back again into parallel relationship to the passing thread. So that the thread can pass through, a greater rotation must be carried out with the result that when the legs are deformed back again into a parallel position, the legs project by a relatively significant amount to the side.

U.S. Pat. No. 997,283 discloses side legs at the heddle eye portion as being displaced crosswise first and then the heddle deformed in the region of the thread eye. This results in a similar drawback as when the thread eye is only rotated and where the beveled segments protrude on the sides, thus possibly damaging the adjacent warp threads.

Because of recent developments in the use of microfibre yarns, together with the increase in the rate of weaving, the aforenoted problems are heightened together with a decline in efficiency thus resulting in increased costs rendering the yarn processing operation less efficient and less profitable. The aforedescribed types of heddles with their thread eye designs have also contributed to a significant share of these problems.

SUMMARY OF THE INVENTION

The object of the present invention is to remedy the aforedescribed drawbacks of current heddles. Problems are solved through a novel combination of certain properties of the known heddle eye portion types and, more importantly, through the addition of a novel orientation of the thread eye legs, as will be described hereinafter.

A further object of the invention is to provide an improved heddle eye passage for the warp thread permitting the warp thread to pass through as trouble-free as possible. The adjacent warp threads are also able to slide past the heddle as easily as possible. Owing to the high speed of weaving machines, the latter feature is quite important due to the high speed with which the adjacent warp threads slide past on the outside of the heddle when the shed is changed.

A still further object of the invention is to provide a heddle having opposed end portions lying on a common flat plane and having a central axis, the heddle comprising an elongated strip of material having a thread eye portion intermediate the end portions. The thread eye portion lies in a plane rotated X degrees about the central axis, and the thread eye portion comprises a pair of spaced legs defining a thread eye therebetween, the legs lying in respective planes parallel to and spaced from opposite sides of the common flat plane of the heddle.

It has been demonstrated that a combination of the two known heddle eye types, such as rotated and crossed, as described above, offers important advantages, wherein it is essential that the two legs of the thread eye are rotated or deformed back again into parallel planes relative to the major flat plane of the heddle. A rotation reduced by about half the known amount is associated according to the invention with a crossing, similarly approximately one-half of the current height. This results in a rotated region of the thread eye to which a crossing is additionally applied. The advantage of this combination is that the deformation is possible, both with respect to the rotation and the crossing, to about one-half of what is traditionally in use. The result with respect to the rotation is sufficient thread support and simultaneously the conditions for the adjacent warp threads are improved. The detour that the adjacent warp threads must travel are dramatically shorter due to the slight deformation. Thus, the stress on the adjacent threads becomes substantially less. In addition, there is less pressure on the heddle to rotate them in their strip plane, a feature that in turn takes a significant amount of stress off the thread in the thread eye.

Another essential feature of the invention relates to the legs of the thread eye. According to the invention, they are not put crosswise in the plane of the rotated portion of the heddle, but are crossed in such a manner that they lie parallel again to the strip plane of the heddle. Thus, the adjacent warp threads do not pass over an edge, but rather they can rest externally on a surface. In addition, the entire expansion of the heddle is further reduced. Thus, the tendency to rotate the heddle is further decreased. Moreover, the small overall width makes it possible to string the heddles closer together on the heddle frame, a condition that is advantageous during fine and dense weaving.

DESCRIPTION OF THE INVENTION

Figure 3:
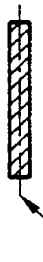
FIG. 3 (PRIOR ART)
FIGS. 3, and 5 are cross-sectional views taken substantially along the lines 3—3, 4—4 and 5—5, respectively, of FIG. 2.
Figure 4:
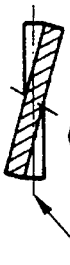
FIG. 4 (PRIOR ART)
Figure 5:
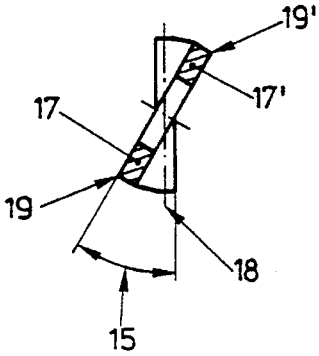
FIG. 5 (PRIOR ART)
Figure 1:
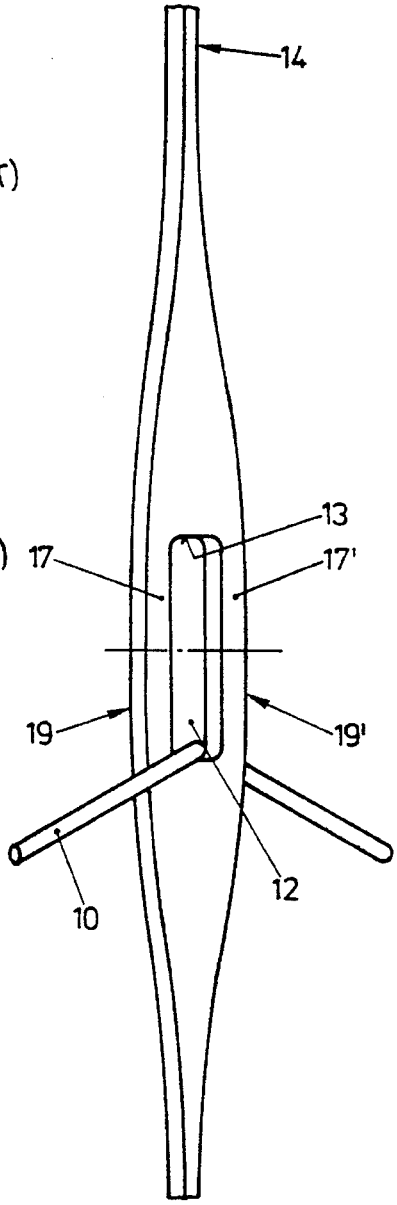
FIG.1 (PRIOR ART)
FIG. 1 is a side perspective view of a heddle according to the prior art and having a rotated thread eye portion.

Heddle 14 is shown in FIG. 1 without the opposed hook ends provided for mounting the heddle to the heddle frame of a weaving machine, in the interest of clarity. The angle of rotation 15 relative to the major plane 18 of the heddle, shown in FIG. 5, is relatively large, usually 25° to 30°. Thus, the thread eye legs 17 and 17' are at large angles to the principle plane 18 of the heddle, as shown in FIGS. 3–5. With such construction, the adjacent warp threads must run over the edges 19 and 19' of the two thread eye legs 17 and 17'. However, the warp threads 10 obtain good support at 13 in the thread eye, since support 13 is significantly expanded.

Figure 2:
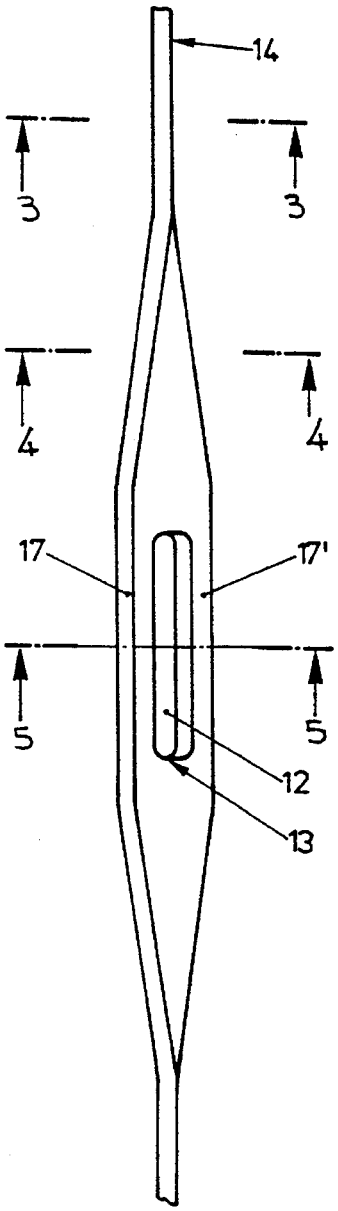
FIG.2 (PRIOR ART)
FIG. 2 is a view similar to FIG. 1 seen in the direction of the warp threads.

FIG. 2 illustrates the same heddle 14 as seen in the direction of the warp threads. FIG. 3 shows the non-rotated region of heddle 14 which is typical at the opposing ends of the heddle. FIG. 4 shows the upper end of this thread eye region as having a slight rotation relative to the principle plane 18, and is typical for the opposing side of the thread eye.

FIG. 5 is a sectional view taken through the center of thread eye 12 with maximum rotation of both legs 17 and 17' relative to principle plane 18. As clearly shown, warp threads running adjacent to heddle 14 can be severely damaged by the two extremely protruding edges 19 and 19' if and when the threads contact such edges. Rotation of both legs 17 and 17' is determined by the angle of rotation 15 which is usually in the range of 25° to 30° relative to plane 18.

Figure 6:
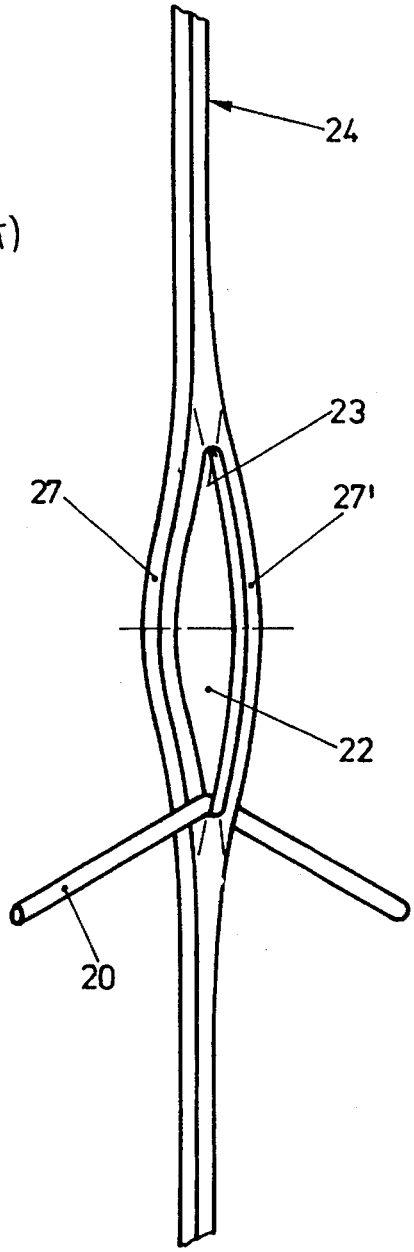
FIG. 6 (PRIOR ART)
FIG. 6 is a perspective view of another prior art heddle having a crossed thread eye portion.

FIG. 6 is a perspective view of a prior art heddle 24 having a crossed type thread eye 22. The two thread eye legs 27 and 27' are pulled apart by a large amount 26 (shown in FIG. 9) in order to provide adequate passage for warp thread 20.

Figure 7:
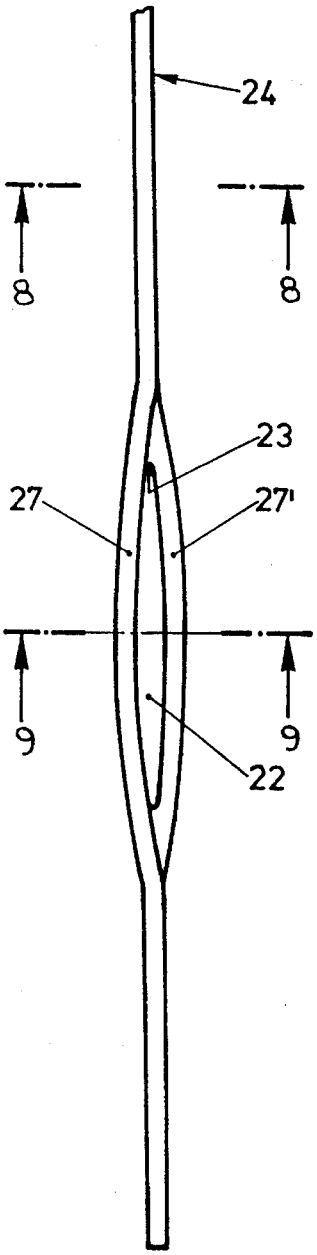
FIG. 7 (PRIOR ART)
FIG. 7 is a view similar to FIG. 6 seen in the direction of the warp threads.
Figure 8:
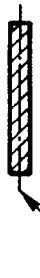
FIG. 8 (PRIOR ART)
FIGS. 8 and 9 are cross-sectional views taken substantially along the lines 8—8 and 9—9 of FIG. 7.
Figure 9:
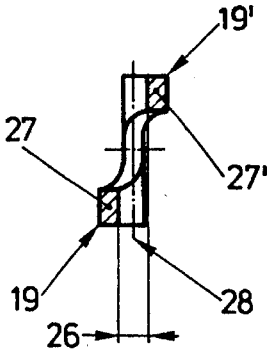
FIG. 9 (PRIOR ART)

FIG. 7 is a view similar to FIG. 6 as seen in the direction of the warp threads, FIG. 8 illustrates a typical region of the non-rotated heddle 24, and FIG. 9 is a view taken through the center of thread eye 22. It can be seen that edges 19 and 19' of this thread eye style do not protrude sideways, but the two thread eye legs 27 and 27' must be pulled far apart to provide an adequately large passage for the warp thread travelling through the thread eye, so that in turn the adjacent heddles or warp threads are influenced by the two legs 27 and 27'. Moreover, FIG. 7 clearly shows that support 23 located at both the top and bottom of thread eye 22 is quite narrow, so that a warp thread can be easily pinched clamped in this region, thereby creating snagging problems.

Figure 13:
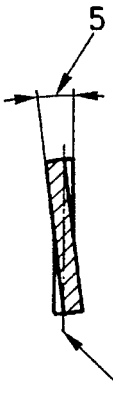
Figure 14:
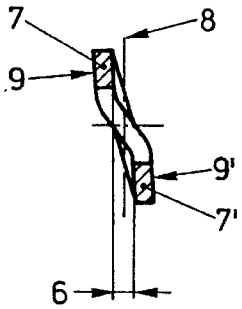
Figure 10:
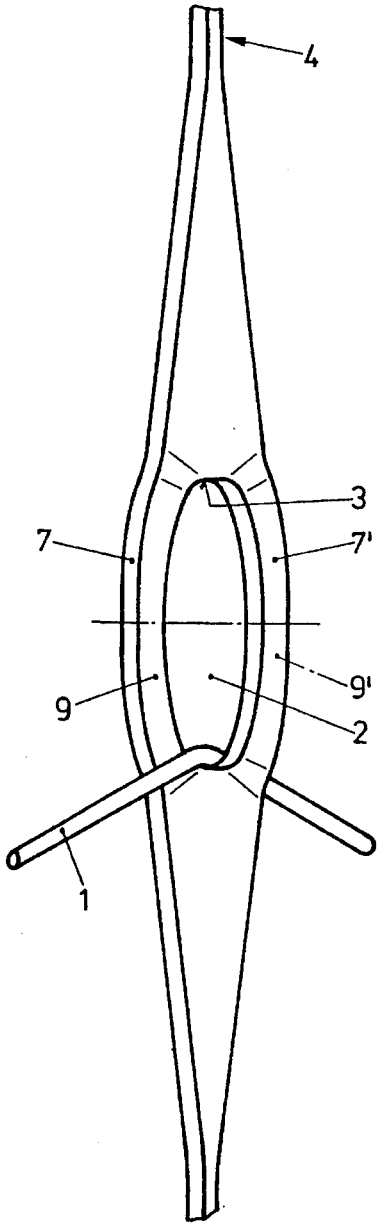
FIG. 10 is a perspective view of the heddle according to the invention having a heddle eye portion which is both rotated and crossed, the legs of which being oriented parallel to the plane of the warp threads.

FIG. 10 illustrates a heddle 4 according to the invention as having a thread eye 2, but without illustrating the hook ends normally provided for mounting the heddle to the heddle frame of a weaving machine. The warp thread 1 has quite good support at 3 of the heddle eye portion and free passage in the crossed and rotated region of the thread eye. Nevertheless, thread eye legs 7 and 7' are rotated only a relatively small amount 5 (see FIG. 13) relative to principle plane 8 of the heddle, and are pulled apart by only a small amount 6 (FIG. 14). The two side faces 9 and 9' of thread eye legs 7 and 7' are also parallel to and at opposite sides of plane 8 of heddle 4. Legs 7 and 7' are spaced apart a distance that corresponds to one-half up to a maximum of one and one-half the thickness of the strip material from which heddle 4 is made, before the legs are rotated back into planes parallel to plane 8.

Figure 11:
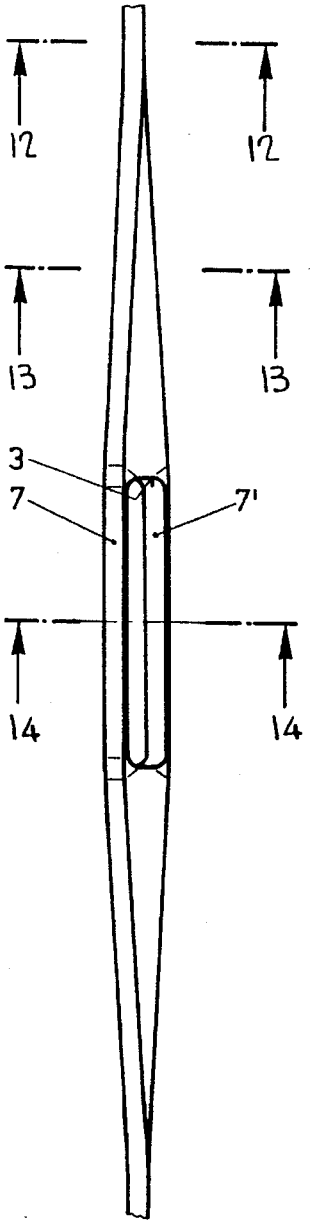
FIG. 11 is a view similar to FIG. 10 seen in the direction of the warp threads.
Figure 12:
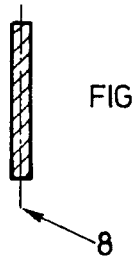
FIGS. 12, 13 and 14 are cross-sectional views taken substantially along the lines 12—12, 13—13 and 14—14, respectively, of FIG. 11.

FIG. 11 is a view similar to FIG. 10 seen in the direction of the warp threads. FIG. 12 illustrates a typical region of the non-rotated heddle 4, and FIG. 13 illustrates the upper end region (typical for the lower end region) of the thread eye rotated through an angle 5 relative to plane 8. FIG. 14 is a view through the thread eye itself where it is apparent that in addition to being rotated there is also a crossing by a distance 6. It is essential to the invention that legs 7 and 7' are formed back again into the plane of the warp threads or into principle plane 8 following completion of the crossing formation, resulting in two external side faces 9 and 9' that are parallel to and spaced on opposite sides of principle plane 8.

The major advantage of the solution according to the invention is that the warp threads running through thread eye 2 are offered a large passage opening and good support both at the top and bottom in the final position. In addition, however, the side deflection of both legs 7 and 7' is quite small. Also, no side edges that could damage the adjacent warp threads protrude outwardly.

The details of the heddle according to the invention as shown in FIGS. 10 to 14 are not intended to limit the scope of the invention. For example, the thread eye shape, the angle of rotation and/or the side deflection can be selected for an execution so as to be different such that the two side legs 7 and 7' can be rounded without the straight segments shown in FIGS. 10 and 11. Also, it is irrelevant whether the thread eye is rotated first followed by a crossing of the legs, or whether the process steps are reversed. What is essential is that the two legs be rotated to lie in parallel planes to the warp threads.

The thread eyes or the heddles of the invention can be produced in any known manner. The advantage of the heddle according to the invention is that both the rotating operation and the crossing operation and finally the rotating back of the legs can be performed by relatively small angles or small distances, virtually ruling out any damage to the heddle during the production process. Thus, it is possible, for example, to carry out the rotation and the crossing of the subsequent return rotation by means of cold deformation during the stamping process. And, heddle 4 may be of hardened steel or of fiber-reinforced plastic material.

What is claimed is:

1. A heddle for mounting on a heddle frame of a weaving machine, comprising an elongated strip of a predetermined thickness having opposed end portions lying in a common flat first plane and having a central axis, said strip having a thread eye portion intermediate said end portions, said thread eye portion lying in a second plane rotated about 15° about said central axis, substantial portions of said strip adjacent opposing ends of said thread eye portion lying in transitional twisted planes between said first plane and said second plane, said eye portion comprising a pair of spaced legs defining a thread eye therebetween, said legs lying in respective planes parallel to and spaced a distance in the range of one-half to one and one-half said predetermined thickness from opposed sides of said common flat first plane.

2. The heddle according to claim 1, wherein inner edges of said legs are uniformly curved in a direction along said axis.

3. The heddle according to claim 1, wherein said strip comprises hardened steel material.

4. The heddle according to claim 1, wherein said strip comprises fiber-reinforced plastic material.

* * * * *